US005438493A

United States Patent [19]

Tseng

[11] Patent Number: 5,438,493

[45] Date of Patent: Aug. 1, 1995

[54] ROLLING BALL-CONTROLLED LIGHT EMITTING DEVICE FOR SHOES

[76] Inventor: Shen-Ko Tseng, No. 28, Lane 41, Chyau-Dong St., Shih-Chih Jenn, Taipei Hsien, Taiwan

[21] Appl. No.: 255,693

[22] Filed: Jun. 8, 1994

[51] Int. Cl.[6] ..... F21V 33/00; A43B 3/00

[52] U.S. Cl. ..... 362/103; 36/137

[58] Field of Search ..... 362/103, 394, 802, 276; 36/137; 273/58 G; 200/62.51, 62.52, 62.48

[56] References Cited

U.S. PATENT DOCUMENTS

| | | | |
|---|---|---|---|
| 2,572,760 | 10/1951 | Rikelman | 36/137 X |
| 4,158,922 | 6/1979 | Dana, III | 36/137 |
| 4,412,205 | 10/1983 | Von Kemenczky | 362/808 X |
| 4,588,387 | 5/1986 | Swenson | 362/802 X |
| 4,697,174 | 9/1987 | Viator, Sr. | 200/62.52 X |
| 4,701,146 | 10/1987 | Swenson | 362/802 X |
| 4,751,628 | 6/1988 | Iacovelli | 200/62.52 X |
| 4,766,275 | 8/1988 | Hemmann et al. | 200/62.52 X |
| 4,848,009 | 7/1989 | Rodgers | 36/137 |
| 5,343,190 | 8/1994 | Rodgers | 362/103 X |

*Primary Examiner*—Ira S. Lazarus
*Assistant Examiner*—Thomas M. Sember
*Attorney, Agent, or Firm*—Pro-Techtor International

[57] ABSTRACT

A light emitting device installed in the sole of a shoe, including a circuit board, a light emitting element controlled by the a circuit board to give light, a battery cell connected to the circuit board through a switch, and a steel ball moved in a curved sliding way to control the switch, wherein when the steel ball passes through the highest point in the middle of the curved sliding way as the shoe is moving, the circuit board is electrically connected to turn on the light emitting element causing it to give light.

4 Claims, 5 Drawing Sheets

ROLLING BALL-CONTROLLED LIGHT EMITTING DEVICE FOR SHOES

BACKGROUND OF THE INVENTION

The present invention relates to a light emitting device adapted to be installed in a sports shoe to emit light as the shoe is moved.

Various sports shoes have been disclosed having special functions. For example: sports shoes with step counters or light emitting devices are known, and widely accepted by people of all ages. A normal light emitting sports shoe is generally comprised of a mercury switch on the sole, and a light emitting element connected to an electronic battery cell through the mercury switch. As the sports shoe is put on the foot and stepped on the ground, the mercury switch is oscillated to alternatively switched on and off causing the light emitting element to flash. As the mercury switch pollutes the environment when the shoe is worn out and thrown away, therefore this structure of light emitting device has been boycotted by environment protective organizations.

SUMMARY OF THE INVENTION

The present invention has been accomplished under the circumstances in view. It is therefore the principal object of the present invention to provide a rolling ball-controlled light emitting device for shoes which uses a rolling steel ball sliding in a sliding way to control the switch of the circuit between the battery cell and the circuit board instead of a conventional mercury switch.

DETAILED DESCRIPTION OF THE PREFERRED EMBODIMENT

Figure 1:
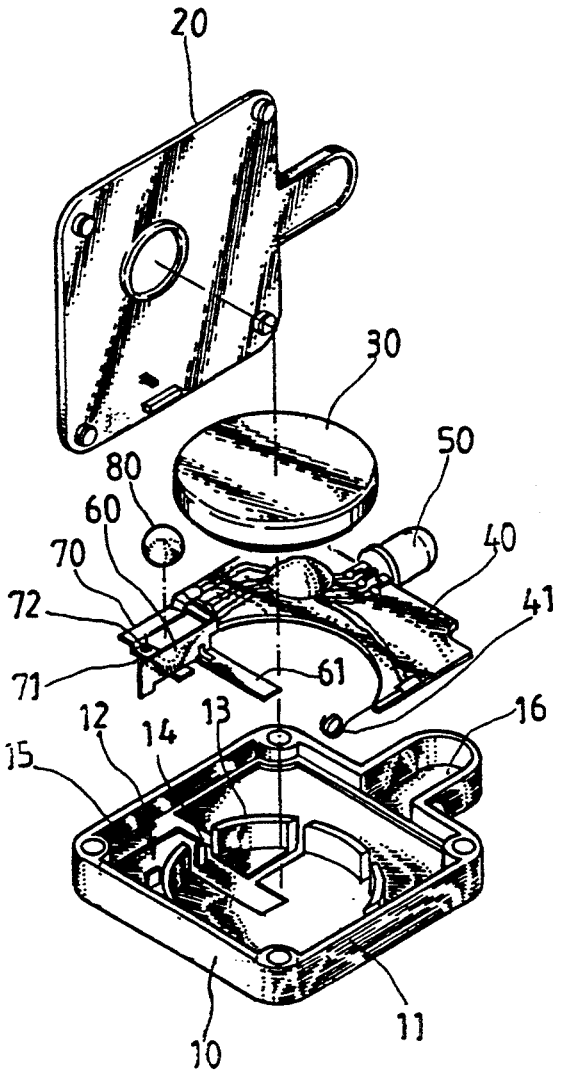
FIG. 1 is an exploded view of a rolling ball-controlled light emitting device according to the present invention.
Figure 2:
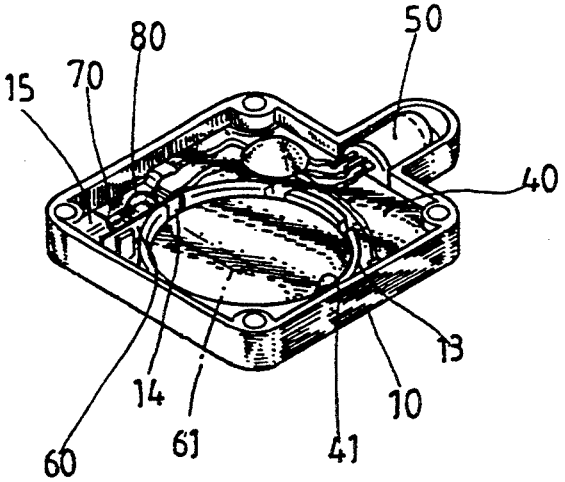
FIG. 2 is an elevational view of the rolling ball-controlled light emitting device shown in FIG. 1.

Referring to FIGS. 1 and 2, a light emitting device according to the present invention is generally comprised of a casing 10 and a cover 20 covered on the casing 10. The casing 10 comprises a circular battery chamber 11, which holds a battery cell 30, a sliding way 12 disposed at one side by the circular battery chamber 11. A circuit board 40 is disposed within the casing 10 above the battery chamber 11. A hole 14 is made on the peripheral wall 13 of the circular battery chamber 11 to impart a passage between the circular battery chamber 11 and the sliding way 12. A raised surface portion 15 is disposed at one side by the sliding way 12 opposite to the hole 14. The casing 10 further comprises a lamp chamber 16, which holds a light emitting element 50. The circuit board 40 has one end (the positive terminal) connected with a conductive plate 70 and an opposite end (the negative terminal) connected with a contact metal wire 41. A contact metal plate 60 is vertically attached to the peripheral wall 13 of the circular battery chamber 11 on the outside, having a horizontal projecting portion 61 inserted into the circular battery chamber 11 and closely attached to the positive terminal of the battery cell 30. The contact metal wire 41 is inserted into the circular battery chamber 11 and closely attached to the negative terminal of the battery cell 30. The conductive plate 70 is horizontally mounted on the raised surface portion 15, having a wing 71 closely attached to the surface of sliding way 12 and disposed across the middle of the sliding way 12. The wing 71 of the conductive plate 70 has a raised portion 72. A steel ball 80 is put in the sliding way 12.

Figure 3:
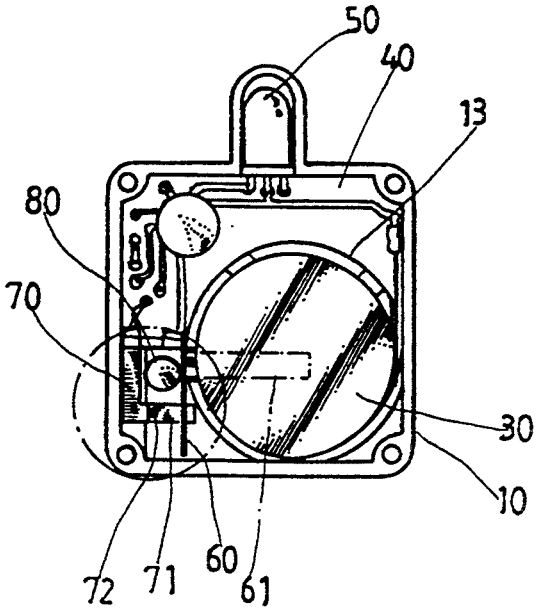
FIG. 3 is a top view taken on FIG. 2.
Figure 4:
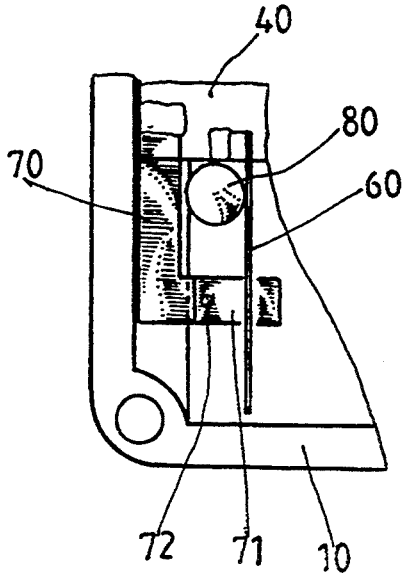
FIG. 4 is an enlarged view taken on part of FIG. 3.

Referring to FIGS. 3 and 4, the sliding way 12 is preferably made having a convex surface 120 gradually smoothly sloping downward toward two opposite ends. Therefore, when the light emitting device is installed in the sole of the shoe and the shoe is disposed in a standing position, the steel ball 80 stays at either end of the sliding way 12 spaced from the wing 71 of the conductive plate 70.

Figure 5:
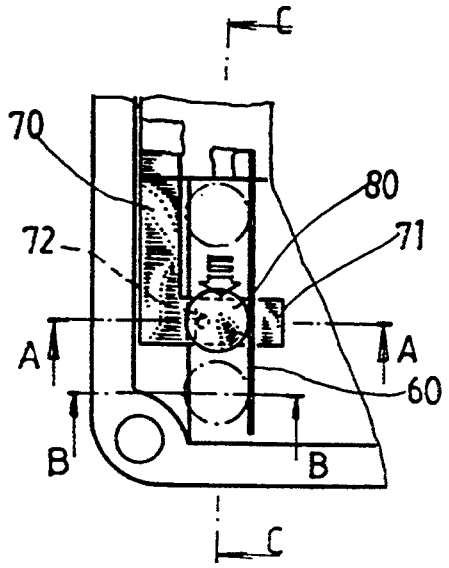
FIG. 5 is similar to FIG. 4 but showing the rolling ball moved.
Figure 8:
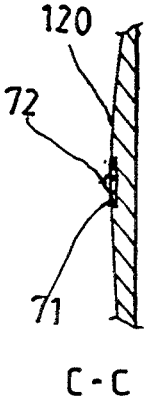
FIG. 8 is a sectional view taken on line C—C of FIG. 5.
Figure 6:
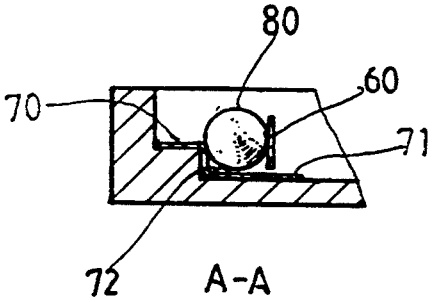
FIG. 6 is a sectional view taken on line A—A of FIG. 5.
Figure 7:
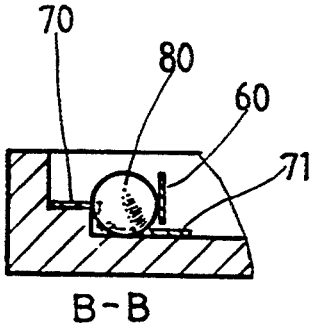
FIG. 7 is a sectional view taken on line B—B of FIG. 5.

Referring to FIGS. 5 and 6, when the shoe is moved, the steel ball 80 is forced to move within the sliding way 12. When the steel ball 80 passes through the wing 71, it simultaneously contacts the contact metal plate 60 causing the circuit board 40 to turn on the light emitting element 50. After passed through the wing 71, the contact metal plate 60 and the conductive plate 70 are electrically disconnected, and therefore the light emitting element 50 is turned off. Therefore, when the shoe is walking, the steel ball 80 is alternatively moved back and forth to intermittently electrically connect the conductive plate 70 to the contact metal plate 60 causing the light emitting element 50 to flash. When the shoe is stopped from moving, the steel ball 80 slides to either end of the sliding way 12 and then stays in place, and therefore the circuit board 40 is electrically disconnected from the battery cell 30 without consuming power supply.

Figure 9:
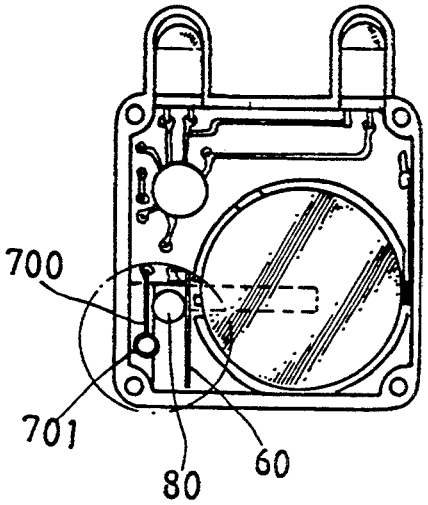
FIG. 9 shows an alternate form of the present invention.
Figure 10:
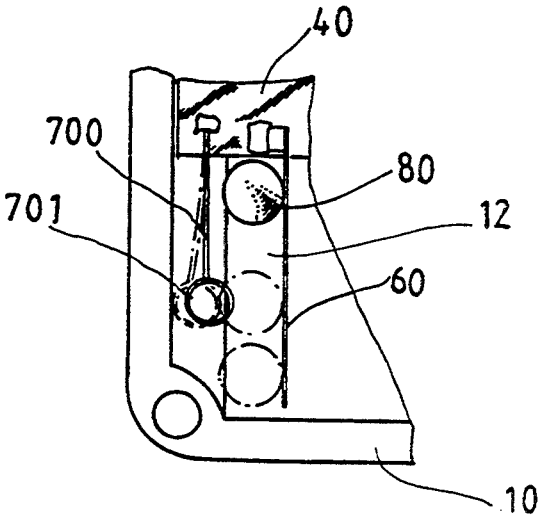
FIG. 10 is an enlarged view taken on part of FIG. 9.

Referring to FIGS. 9 and 10, therein illustrated is an alternate form of the present invention. In this alternate form, a spring element 700 is installed to replace the aforesaid conductive plate 70. This spring element 700 has one end welded to the circuit board 40 and an opposite end terminating in a head 701 suspended inside the casing 10. The head 701 of the spring element 700 partially projects into the sliding way 12. When the steel ball 80 passes over the head 701 of the spring element 700, the spring element 700 and the contact metal plate 60 are electrically connected causing the light emitting element turned on.

What is claimed is:

1. A light emitting device adapted to be installed in the sole of a shoe comprising:

a casing covered with a cover and having a battery chamber to hold a battery cell and a sliding way at one side of the casing alongside the battery chamber, a circuit board disposed above said battery chamber, a light emitting element disposed inside said casing and controlled by said circuit board to give light, a first contact metal element having one end connected to a negative terminal of said battery cell and an opposite end connected to a negative terminal of said circuit board, a second contact metal element having one end connected to a positive terminal of said battery cell and an opposite end attached to a negative terminal of the circuit board, a third contact metal element having one end connected to the positive terminal of said circuit board and an opposite end attached to a first end of the sliding way, and a steel ball that moves between the first end of the sliding way and a second opposing end of the sliding way, and wherein when the shoe is moved, said steel ball is forced to pass through a gap between said second and third contact metal elements causing said circuit board to turn on said light emitting element.

2. The light emitting device of claim 1 wherein:

said third contact metal element is mounted on a raised surface portion along the second side of said sliding way, said third contact having a wing located between the first and second opposing ends of the sliding way and spanning said sliding way, said wing being substantially perpendicular to a longitudinal axis of the sliding way.

3. The light emitting device of claim 2 wherein:

said wing of said third contact metal element has a raised portion, which forces said steel ball to contact said second contact metal element when said steel ball passes from the first end of said sliding way to the second end of said sliding way.

4. The light emitting device of claim 1 wherein:

said third contact metal element is a metal spring having one end attached to the positive terminal of said circuit board and an opposite end terminating in a head suspended inside and partially projecting into a middle portion of said sliding way.

* * * * *